US006652307B2

(12) United States Patent
Tatz

(10) Patent No.: US 6,652,307 B2
(45) Date of Patent: Nov. 25, 2003

(54) MULTIPLE ELECTRICAL PLUG LOCKING APPARATUS

(76) Inventor: Eliezer Tatz, 201-180 Drive #209, North Miami Beach, FL (US) 33160

( * ) Notice: Subject to any disclaimer, the term of this patent is extended or adjusted under 35 U.S.C. 154(b) by 0 days.

(21) Appl. No.: 10/299,380

(22) Filed: Nov. 19, 2002

(65) Prior Publication Data

US 2003/0176097 A1 Sep. 18, 2003

Related U.S. Application Data

(63) Continuation-in-part of application No. 10/098,065, filed on Mar. 13, 2002.

(51) Int. Cl.[7] ..... H01R 13/625
(52) U.S. Cl. ..... 439/346; 439/134
(58) Field of Search ..... 439/134, 133, 439/346, 347

(56) References Cited

U.S. PATENT DOCUMENTS

| | | | | | |
|---|---|---|---|---|---|
| 4,563,048 | A | * | 1/1986 | Im | 439/134 |
| 5,288,239 | A | * | 2/1994 | Johnson | 439/134 |
| 5,316,493 | A | * | 5/1994 | Sowers | 439/346 |
| 5,330,361 | A | * | 7/1994 | Brend | 439/134 |
| 6,315,593 | B1 | * | 11/2001 | Bentley et al. | 439/346 |

* cited by examiner

*Primary Examiner*—Gary Paumen
(74) *Attorney, Agent, or Firm*—Christopher & Weisberg, P.A.

(57) ABSTRACT

The invention is a compact locking device for locking one or more standard male electrical plugs therein in order to prevent their removal and unwanted use. Each plug includes prongs with openings thereon. The device comprises one or more prong-receiving grooves and an elongated channel extending longitudinally through at least a portion of the receptacle, the elongated channel positioned transverse to the longitudinal direction of the grooves. After inserting the prongs of the plugs into the groves of the receptacle, a locking mechanism having an elongated prong-securing member coupled thereto is inserted into the channel and the elongated member, which is sized to fit through the prong openings, pierces travels through the channel and pierces each of the prong openings thereby securing the plugs within the receptacle. The locking mechanism is a common cylindrical lock that includes a locking flange on its exterior surface. After inserting the cylindrical lock in the channel, a key is turned or a combination lock is activated and the flange engages a receiving notch within the interior of the receptacle. The lock therefore remains in the channel and the elongated member prevents the electrical plugs from being withdrawn. In an additional embodiment, a receptacle contains grooves that receive the prongs of one or more plugs. A channel, transverse to the length of the grooves, extends the substantial length of the receptacle and receives a cylindrical lock and an elongated member attached thereto. The elongated member pierces the openings in the prongs thereby securing the prongs within the receptacle.

11 Claims, 6 Drawing Sheets

MULTIPLE ELECTRICAL PLUG LOCKING APPARATUS

CROSS-REFERENCE TO RELATED APPLICATION

This application is a continuation-in-part of pending application Ser. No. 10/098,065, filed Mar. 13, 2002, by Eliezer Tatz, entitled MALE ELECTRICAL PLUG LOCKING DEVICE, and incorporated herein by reference.

STATEMENT REGARDING FEDERALLY SPONSORED RESEARCH OR DEVELOPMENT n/a

FIELD OF INVENTION

The field of the invention relates generally to locking devices and particularly to a locking device for electrical appliances and electrical power tools having a male electrical plug in order to prevent the unwanted use of said appliances or tools.

BACKGROUND OF INVENTION

Common electrical appliances such as computers, televisions, toasters and microwave ovens often need protection from unauthorized use Further, electrical power tools such as electric drills and saws can be hazardous if left unattended Protection may often be best obtained through a locking device that is made operational by a key This protection could be used to prevent children from using dangerous appliances, or handling unprotected electrical power tools or to prevent unauthorized use of the appliance in places such as electronics stores While there are several possible solutions to the problem, a simple, easy-to-manufacture device is needed which has a minimal number of moving parts.

Other locking devices for electrical devices are known. 25 U.S. Pat. No. 6,142,797 issued to Bailey teaches a device that uses oddly shaped functional components in its interior that would be difficult to manufacture and could easily break. Also, U.S. Pat. No. 6,159,025 issued to Derman teaches a lock. However, the Derman reference requires a sturdy cable through the body. In addition, U.S. Pat. No. 5,666,829, issued to Aikens teaches a plug lock. However, in the Aikens device, a bolt spreads the prongs of the plug. Over time, the spreading of the prongs of the electrical plug would cause significant damage to the device. Also, U.S. Pat. No. 5,507,656 issued to Ales requires several moving parts that may break, and an extra securing device such as a padlock. Ales requires two springs, a coil spring and a flat spring, thereby unnecessarily increasing the cost of production. Also, Ales, includes a bulky and unwieldy plunger to release the device from the lock.

The prior art inventions are flimsy, bulky, and expensive or require additional, unnecessary parts in their manufacture. Accordingly, what is needed is a lock for a male electrical plug that is simple and easy to manufacture. A need also exists for a lock with a minimum of moving parts. In addition, a lock is needed which will secure the electrical device and prevent its unwanted use while not damaging the plug or the device itself.

The instant invention has been directed to the effective resolution of the aforementioned shortcomings and to the meeting of the aforementioned needs.

BRIEF SUMMARY OF THE INVENTION

The present invention provides a novel and unique compact locking device for securing and locking an appliance's electrical power cord plug thereby preventing the unwanted use of the appliance. The present invention is compact, lightweight and easy to manufacture. The present invention will secure an electrical appliance with a minimal number of moving parts. Also, the present invention is easier and less costly to manufacture than the prior art, and has none of the fragile pieces found in the prior art.

The present invention is a compact locking device for securing a male power cord plug having a plurality of prongs, the device comprising a body member having one or more plug-receiving apertures for receiving the prongs of the plug, each prong containing one or more holes, means for rotatably receiving a portion of a key, a rotatable member situated within the body member capable of rotating from a first disengaged position to a second engaged position, the rotatable member rotating in the same direction as the rotation of the key, and means for engaging the holes of the prongs upon rotation of the key thereby preventing the prongs from being withdrawn from the body member.

In a preferred embodiment, the locking device comprises a body member having one or more plug-receiving apertures for receiving the prongs, each prong containing one or more holes, a key-lock mechanism within the body, the key-lock mechanism including a channel for receiving a portion of a key, the key capable of being rotated within the channel, and a spring member secured within the body member, the spring member having two outer arm members, each outer arm member having a knob disposed upon its outer edge wherein the elongated member is positioned between the outer arm members. The key-lock mechanism further comprises an elongated member wherein the elongated member rotates from a first substantially parallel position with respect to the arm members, to a second substantially transverse position with respect to the arm members, the elongated member rotating in the same direction as the rotation of said key. Upon rotation of the key within the channel, the elongated member is rotated from the first to the second position thereby biasing the outer arm members outward. Upon the outward biasing of the arm members, the knobs of the spring member cooperatively engage the holes in the prongs of the plug thereby preventing the prongs from being withdrawn from the body member.

In an alternate embodiment of the invention, the plug receiving apertures are located on the body member such that a ground fault disruptor prong on the plug would be located outside the device when the prongs are inserted within the apertures. In an alternate embodiment, the body member further comprises an opening to accommodate the ground fault disruptor prong in the plug.

The present invention is also a method for securing a male power cord plug with prongs having holes within a body member, comprising the steps of inserting the prongs of the plug within one end of the body member, inserting a key within another end of the body member, upon rotation of said key, outwardly biasing two outer arm members of a spring, the spring affixed within the body member, wherein each outer arm member has a knob thereon whereby upon rotation of the key within the body member, the knobs of the spring cooperatively engage the holes in the prongs of the plug thereby preventing the prongs from being withdrawn from the body member.

In a further embodiment of the present invention, a compact locking device is provided for securing a male power cord plug with prongs having holes. The locking device comprises a rigid plastic body with an interior and an exterior, a top, a bottom, a front, a back, a left and a right side, wherein each side has an inner and outer surface. The body includes two apertures on the back side of the body, each aperture for accommodating one of the prongs, a key-activated lock assembly accessible on the front side of the body for locking and unlocking the plug, an elongated member cooperatively attached to the lock-activated assembly, the elongated member rotatable to a transverse position in relation to the plug when the lock assembly is engaged, and an inwardly biased generally V-shaped spring with a base and two outer arm members, each outer arm member having an outside section and a circular knob thereon. The base of the spring is attached to the inner surface of the body, and the knobs are in cooperative connection with the holes in the prongs when the lock-activated assembly is engaged. The knobs are released from the holes in the prongs when the lock-activated assembly is disengaged. The apertures are located so that a ground fault disruptor on the plug would be located outside the device when the prongs are within the apertures.

In yet another embodiment of the invention, a compact locking device is provided for securing one or more standard male power cord plugs having one or more prongs. The prongs of the plug, with the exception of the ground prong, includes an opening. The device comprises a receptacle for housing the male electrical plugs. The receptacle includes a plurality of prong-receiving grooves and an elongated channel extending longitudinally through at least a portion of the receptacle. The elongated channel is positioned transverse to the longitudinal direction of the grooves. The device also includes a locking mechanism comprised of a cylindrical lock and an elongated prong-securing member coupled to the-cylindrical lock. The elongated member is sized to fit through the prong openings, where upon insertion of the cylindrical lock within the receptacle, the prong-securing member pierces the opening in each prong thereby securing the electrical plugs within the receptacle.

The cylindrical lock further includes a locking flange. Upon activation of the cylindrical lock, typically by the rotation of a key or the rotation of combination dials, the locking flange engages a retaining notch located within the interior of the receptacle. If a key is used, it can then be removed, leaving the cylindrical lock engaged within the receptacle. The electrical plugs cannot be removed from the receptacle due to the piercing of the prong openings by the elongated member.

It is an object of the invention to provide an easy-to-manufacture locking device for male electrical plugs in order to prevent the unauthorized use of electrical appliance and/or electrical power tools.

It is also an object of this invention to provide a locking device with a minimal number of moving parts.

It is also an object of this invention to provide a compact device small enough to fit into a user's pocket during nonuse, and that minimizes space by allowing a plurality of male electrical plugs to be secured by aligning and retaining pairs of plugs on opposing sides of the device.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages,. and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE SEVERAL VIEWS OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 3:
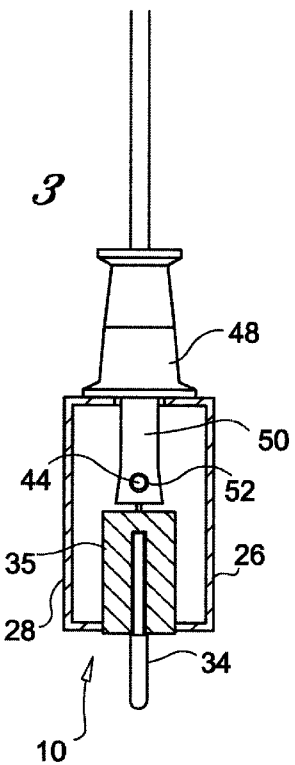
FIG. 3 is a cut-away side view of the preferred embodiment of the invention in the locked position.

The present invention is a compact locking device for securing an electrical power cord male plug as shown in FIGS. 1 through 7 and described generally at 10.

As shown in FIGS. 1–7, the device has a rigid body 12 with interior surfaces 14 and exterior surfaces 16, top side 26, bottom side 28 (not shown), front side 18, back side 20, left side 24 and right side 22, wherein each side has an inner and outer surface. Body 12 can be made of any suitable sturdy material such as plastic, metal or the like. Body 12 preferably has two vertical slits 30 situated on the back side for accommodating prongs 50 of a male electrical plug 48. It is preferred that body 12 be made of hard plastic or metal to keep plug 48 secure therein.

Body 12 also has an aperture 32 on the exterior surface 16 of body 12. Aperture 32 represents the open end of channel 33. Channel 33 is sized to receive a standard key 34 and is designed for locking and unlocking plug 48. It is preferred that aperture 32 be positioned is on front side 18 of body 12, and that the locking capability of device 10 is activated by the insertion and rotation of key 34. However, other locations for the aperture, such as top side 26 or bottom side 28 may be preferred for certain applications. In addition, other locking activation means are also known in the art, such as a magnetic lock or a touchpad with code.

Figure 2:
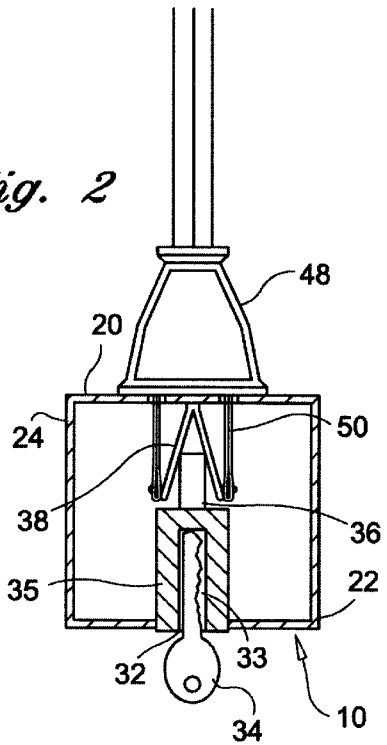
FIG. 2 is a cut-away top view of the preferred 20 embodiment of the invention in the locked position.
Figure 1:
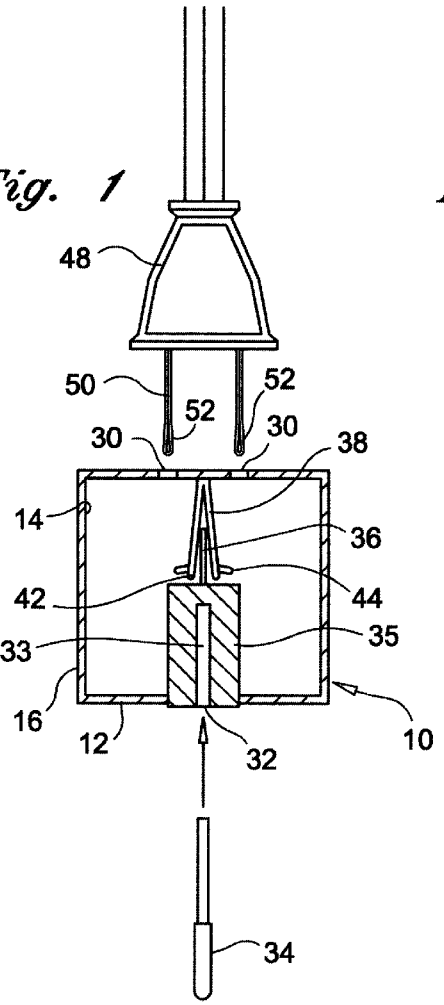
FIG. 1 is a cut-away top view of the preferred embodiment of the invention.

An elongated member 36 is contained within body 12 and is in contact with locking assembly 35. Elongated member 36 is cooperatively engaged to assembly 35, as shown in FIG. 1. Preferably, member 36 is made from metal, plastic or other sturdy material. As shown in FIGS. 1 and 2, member 36 presents a narrow profile in relation to prongs 50 prior to the insertion of key 34, i.e. when the device is inactivate.

Referring to FIG. 2, upon the insertion and rotation of key 34 within channel 33, assembly 35 rotates along with key 34. Assembly 35 is a key-lock assembly common in the art and typically used in locking devices where a key is needed to rotate the locking mechanism Elongated member 36 is likewise rotated to a wider, transverse position in relation to plug 48, so that member 36 presents a wider profile between prongs 50.

Figure 4:
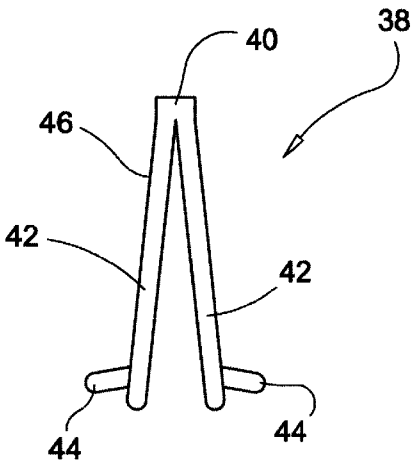
FIG. 4 is a side view of the spring mechanism of the invention.

Located on the interior 14 of body 12 is an inwardly biased generally V-shaped spring 38. Spring 38 may be made of metal, plastic or any other resilient material. Spring 38, preferably comprised of tempered steel, is illustrated in FIG. 4. Spring 38 preferably has a base 40 and two outer arm members 42, each having one end joined at base 40. Base 40 is affixed to the interior 14 of back side 20 of body 12 between slits 30. Outer arm members 42 enclose elongated member 36, as depicted in FIG. 1 and FIG. 2. A knob 44 is located on the outer surface 46 near the end of each outer member 42 of spring 38.

As shown in FIG. 4, it is preferred that knobs 44 are a distance from the very tip of the outer members 42. However, knobs 44 alternatively may be located on the very tips of the outer members 42. Spring 38 is located within body 12, and in cooperative contact with elongated member 36.

When plug 48 of an electrical appliance or an electrical power tool is inserted into device 10 and it is desired to secure and lock the plug therein in order to prevent the use of the device, key 34 is inserted into aperture 32 and the device is engaged. Upon the rotation of the key into channel 33, assembly 35 rotates, and elongated member 36 is also rotated in the same direction as the rotation of key 34 due to its cooperative engagement with assembly 35, and a wider profile of member 36 is presented with respect to prongs 50. Upon rotation, member 36 spreads apart outer arm members 42 of spring 38, as shown in FIG. 2. As outer arm members 42 spread apart, knobs 44 engage the holes 52 in prongs 50 of plug 48, thereby firmly securing the prongs 50 of plug 48 within device 10.

In an alternate embodiment, when key 34 is inserted and rotated, outer arm members 42 of spring 38 are again forced laterally outward by member 36, but instead of holes 52 of prongs 50 receiving knobs 44 to secure the plug within body 12, outer arm members 42 are forced outward and "trap" each prong 50 against the inner wall of body 12. In this fashion, prongs 50 are pressed against the interior walls of body 12 by the outward lateral movement of each arm member 42 due to the rotation of key 34 within body 12 and the rotation of member 36. The result is the same, i.e. prongs 50 of plug 48 are trapped within body 12 as long as the key remains in a locked position. This embodiment is particularly useful in instances where there are no holes in the prongs of the plug.

As shown in FIGS. 1 and 2, spring 38 is attached to the interior side 14 of back side 20 of body 12, so long as knobs 44 on spring 38 engage holes 52 when elongated member 36 presents its wider profile in relation to prongs 50. However, spring 38 may alternatively be attached to interior side 14 of front side 18 of body 12. Alternatively, spring 38 may be also formed as an intrinsic part of the interior 14 of device 10 to simplify the manufacturing process.

Knobs 44 are in cooperative engagement with holes 52 in 25 prongs 50 when the key is inserted in aperture 32 and rotated within chamber 33. The inwardly biased tension in spring 38 releases knobs 44 from their cooperative engagement with holes 52 when the key is rotated back to its initial (insertion) position. For ease of manufacturing, knobs 44 are an intrinsic part of spring 38. However, knobs 44 may alternatively be attached to spring 38 in a separate manufacturing process. As shown in FIG. 4, knobs 44 are preferably rounded to facilitate engagement. However, other shapes that would allow for engagement with holes 52, such as cones or cylinders, are also contemplated.

Figure 6:
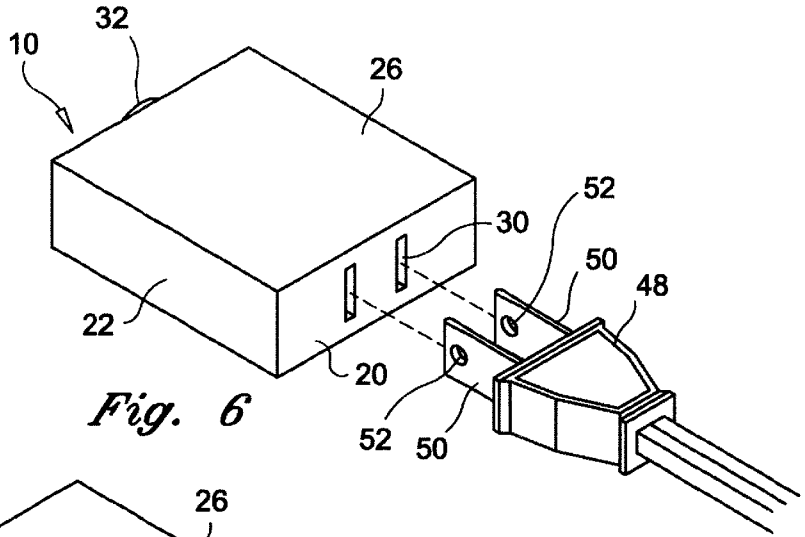
FIG. 6 is a perspective view of the preferred embodiment showing the vertical slits into which an electrical plug may be inserted.
Figure 5:
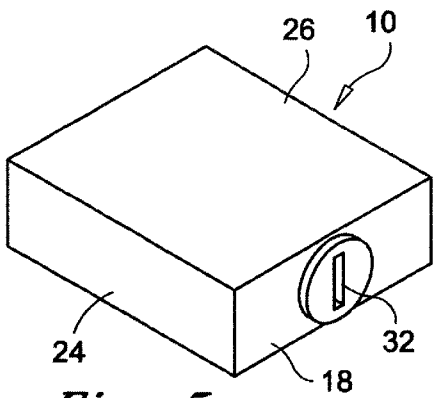
FIG. 5 is a perspective view of the preferred embodiment showing the locking mechanism of the invention.

In the preferred embodiment, as shown in FIGS. 5 and 6, slits 30 are located so that a ground fault disruptor located below prongs 50 on plug 48 would be located outside the device 10 when the prongs 50 are inside the slits 30.

Figure 7:
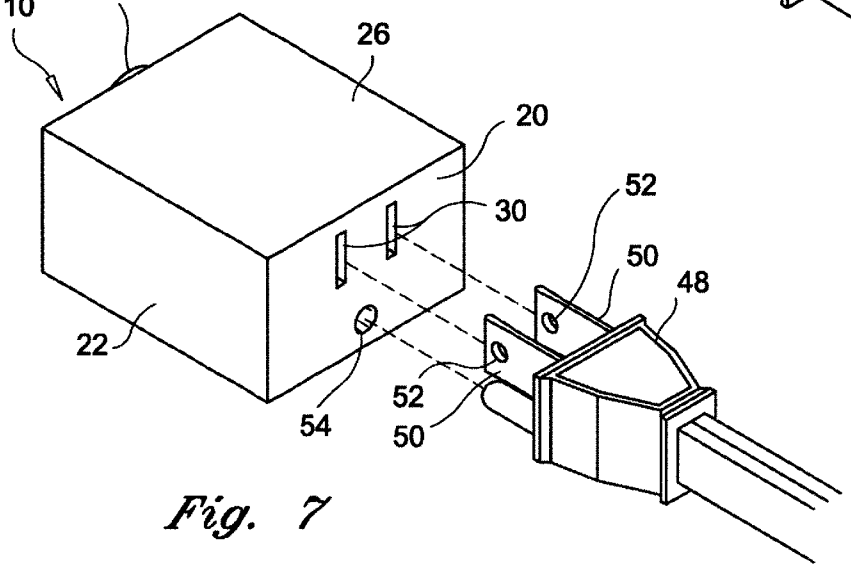
FIG. 7 is a perspective view of an alternative embodiment of the invention.

In an alternative embodiment, shown in FIG. 7, back side 20 of body 12 further includes an opening 54 for a ground fault disruptor prong in plug 48.

Figure 8:
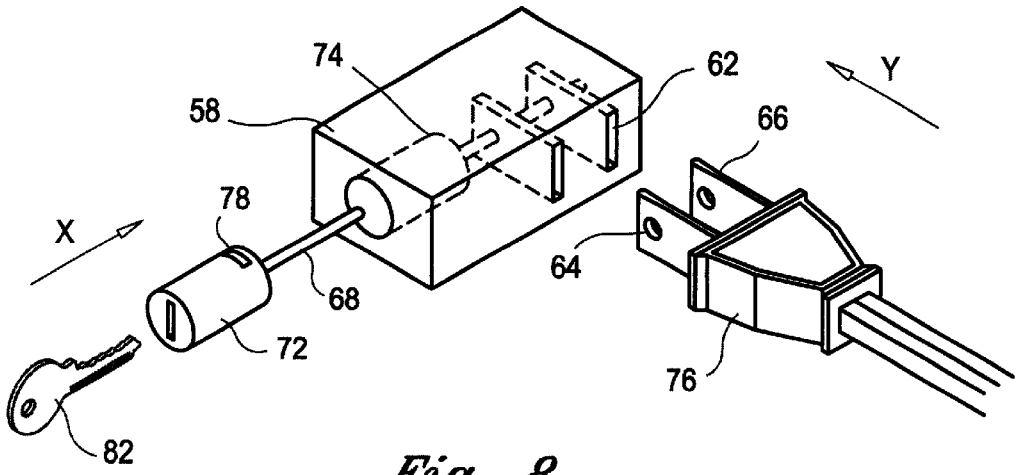
FIG. 8 is a perspective view of an alternate embodiment of the present invention.

Referring now to FIG. 8, an alternate embodiment of the present invention is illustrated. Receptacle 58 has a longitudinal axis X and includes one or more prong-receiving grooves 62. Each groove 62 has a longitudinal axis Y disposed transverse to longitudinal axis X. Grooves 62 are sized to receive the prongs 66 from standard male electrical plugs, commonly used in household outlets. The length of each groove 62 is the substantially the same to allow the holes 64 in the prongs 66 of an electrical plug 76 to be aligned relative to the holes in the other prongs.

Locking mechanism 70 is comprised of a cylindrical lock 72 and an elongated member 68. Elongated member 68 can either be an integral part of cylindrical lock 72 or can be manufactured separately and affixed to lock 72. Member 68 can be permanently affixed (e.g. soldered) or removably affixed (e.g. screwed onto) cylindrical lock 72. It is preferred that locking mechanism 70 include a cylindrical lock 72 in order to fit into a channel 74 (shown in FIG. 9) of receptacle 58, which is also substantially cylindrical. However, it is within the scope of the invention to provide any shaped lock, and compatible chamber. A key 82, combination lock or other locking device is part of locking mechanism 70. In this embodiment, key 82 is inserted into slot 83 on one end of cylindrical lock 72. Once the key 82 is inserted into slot 83 it can be removed, and lock 72 left in place within channel 74 by simply turning the key a quarter-turn. This allows the user to remove the key, keeping the cylinder lock 72 and elongated member 68 attached thereto, in place.

Figure 9:
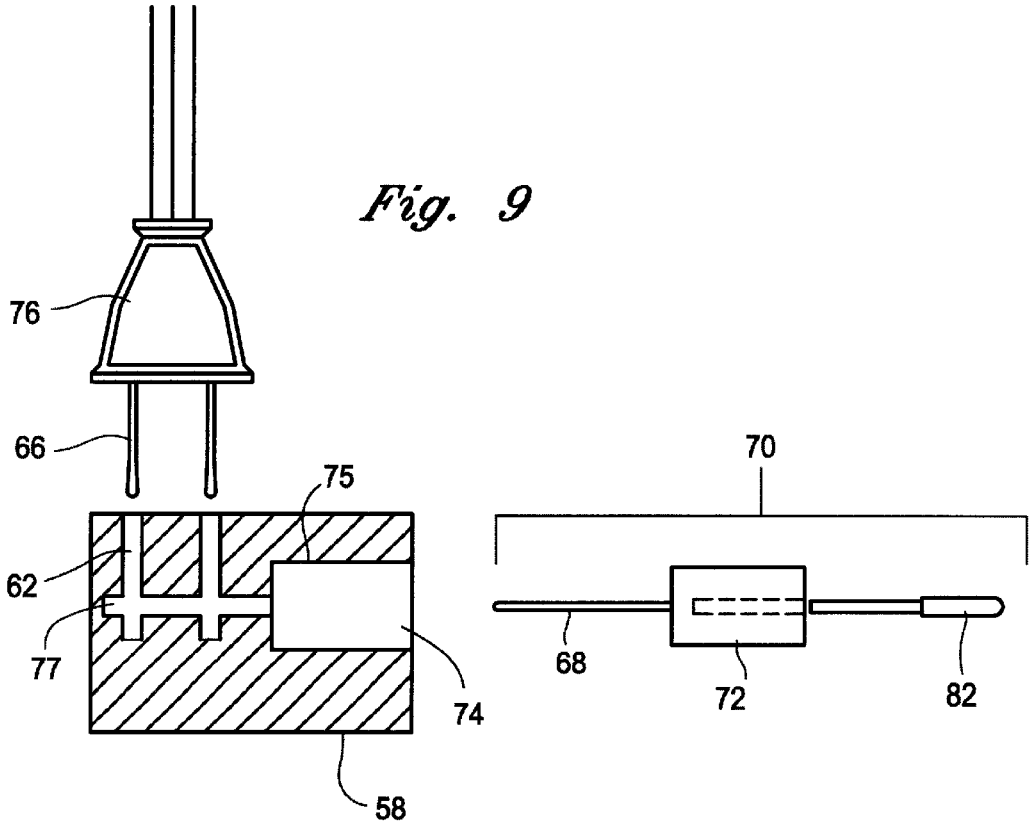
FIG. 9 is a top view of the multiple plug-locking device of FIG. 8.
Figure 10:
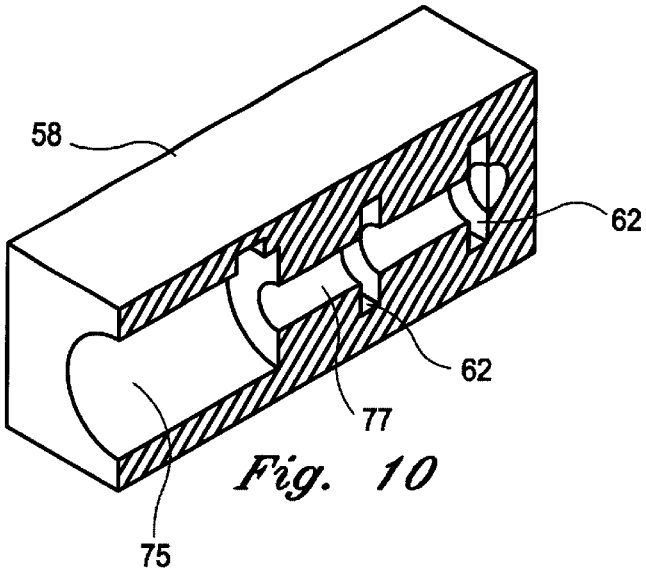
FIG. 10 is a cut-away view of the receptacle of the multiple plug-locking device of FIG. 8.
Figure 11:
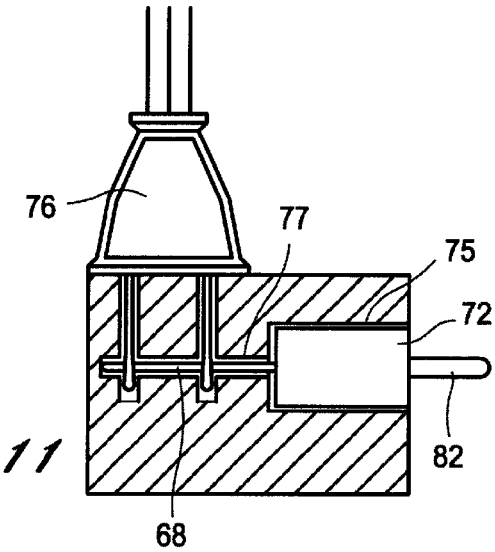
FIG. 11 is a top view of the multiple plug-locking device of the present invention after insertion of the electrical plug and the locking mechanism.

FIG. 9 is a top down view of the present invention. Here, channel 74 can be seen to run the substantial length of the interior of receptacle 58. FIG. 10 shows receptacle 58 in a cut away view. Channel 74 has a first portion 75 to receive both member 68 and cylindrical lock 72. The first portion 75 of channel 74 is of a slightly larger diameter than lock 72. Channel 74 includes a second tapered portion 77 that is much narrower than the first portion to allow only member 68 to extend therethrough. As shown in FIG. 11, member 68 extends throughout the substantial length of receptacle 58 and pierces the openings 64 of each prong 66.

Figure 12:
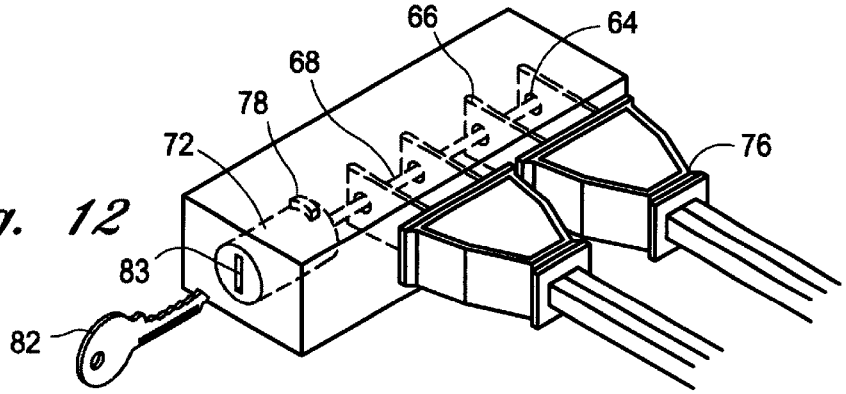
FIG. 12 is a top view of the present invention retaining the prongs of multiple plugs within its receptacle.

To utilize the locking device, one or more male electrical plugs 76 are inserted into grooves 62 of receptacle 58. Each plug 76 is inserted completely within receptacle 58 until it can go no further. Because grooves 62 are of substantially the same length, each opening 64 in each prong will be aligned with the other openings in other prongs. In an alternate version of the invention, a bar can be inserted along the longitudinal axis of the receptacle 58 in order to act as a guide and prevent the prongs 66 from being inserted too far within receptacle 58. FIG. 12 shows the device after lock 72 has been inserted into channel 74 (FIGS. 9–11) within receptacle 58 and member 68 has engaged openings 64 in each prong 66. The prongs 66 are properly aligned within receptacle 58 either by their complete insertion into the grooves 62. Further, the prongs 66 may be aligned by use of an elongated clamping mechanism (not shown), which can be inserted within the receptacle 58. The clamping mechanism is comprised of multiple clamps, each of which receives a prong. The clamping mechanism is positioned inside receptacle 58, along its top portion, and "grabs" each prong 66 from above, leaving the opening 64 in each prong exposed. In this fashion, the openings 64 in the prongs 66 can be aligned to receive the elongated member 68.

Figure 13:
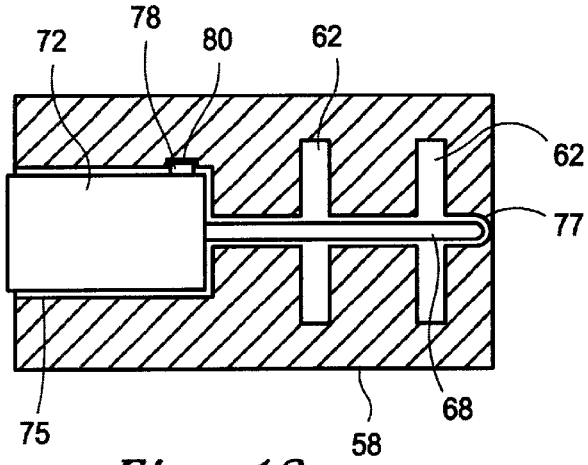
FIG. 13 is a top perspective view of the present invention after the locking mechanism has been secured within the receptacle.

To secure the locking mechanism 70 and thereby lock the plugs within the receptacle, a locking flange 78 is disposed along the top outer rim of lock 72. This can be seen in FIG. 13. Flange 78 is a standard retractable flange common to most cylinder-type locks. The flange is forced downwards into a first retractable position when the lock 72 is being inserted within the channel 74. Notch 80 is positioned within channel 74 and receives flange 78 to engage lock 72 within channel 74. As lock 72 moves along within channel 74, flange 78 remains retracted. When lock 72 is substantially proximate notch 80, flange 78 springs upward "catching" notch 80 and securing lock 72 within the channel 74. If a key 82 is used, it can be removed at this point, leaving behind lock 72 secured (by the flange-notch interaction) within the large portion of channel 74 and the elongated member 68 extending throughout the narrow, tapered portion 77 of the channel 74.

Figure 14:
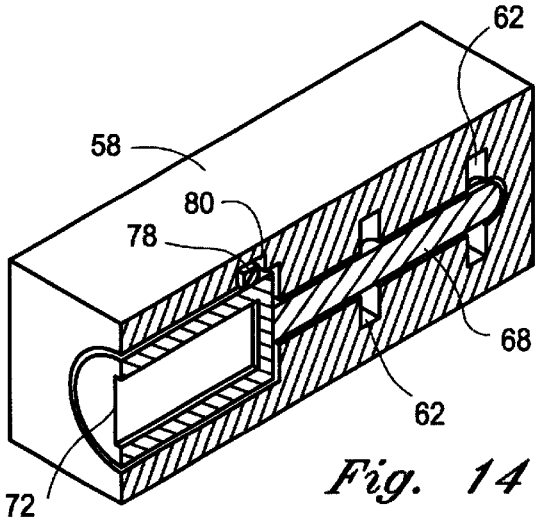
FIG. 14 is a top view of the present invention after the locking mechanism has been secured within the receptacle showing the interaction of the locking flange and internal notch of the multiple plug-locking device.

FIG. 14 illustrates a cross-sectional view of receptacle 58 securing one electrical plug 76, after cylindrical lock 72 has been secured within its channel 74, and key 82 removed.

Figure 15:
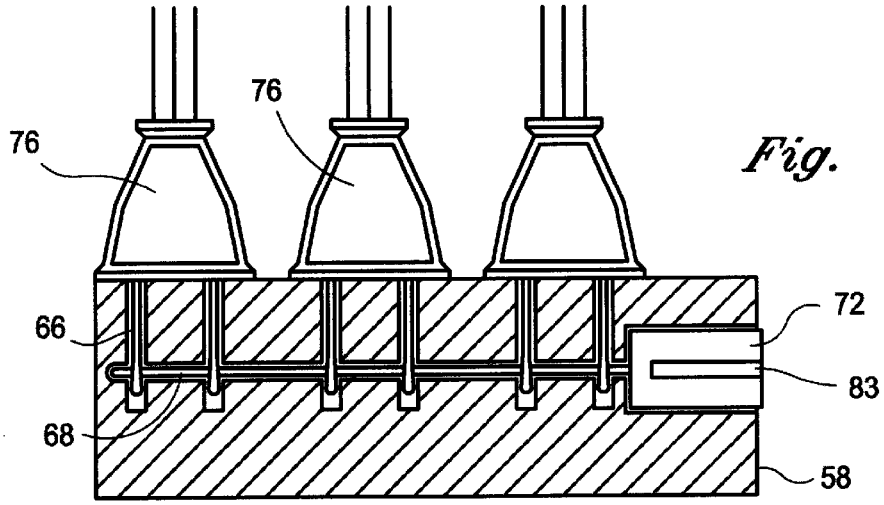
FIG. 15 is a cut-away view of the present invention after the locking mechanism has been secured within the receptacle.

FIG. 15 illustrates the locking device of the present invention used to lock multiple plugs in a side-by-side manner. Therefore, an unlimited number of electrical plugs may be secured with the present invention as long as elongated member 68 is of sufficient length to pierce each prong opening.

Although the locking device depicted in FIGS. 8–15 allow for the locking of multiple male electrical plugs, it may be desirable to have a locking device that can accomplish the same function yet be small enough to fit easily into a user's pocket. The locking device in FIG. 16 includes grooves 62 disposed on opposite sides of receptacle 58. Although the grooves 62 are disposed in the same transverse direction as the previous embodiment, pairs of grooves now overlap each other such that the prong 66 of one plug is between the prongs of an opposing plug. In this fashion, may plugs may be retained within the receptacle 58 while utilizing minimal space.

Figure 16:
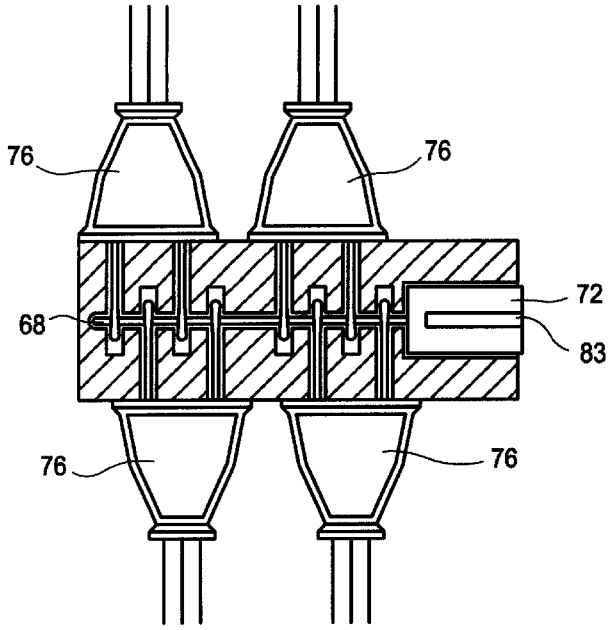
FIG. 16 is an alternate view of the multiple plug-locking device of the present invention.

The illustration in FIG. 16 is just an exemplary view and other configurations where a plurality of electrical plugs are contained within receptacle 58 are within the scope of the invention. For example, receptacle 58 may be in the shape of a cross, with plugs retained along the vertical and horizontal portions of the receptacle, or two or more receptacle may be stacked on top of each other, and affixed to each other. In these embodiments, as well as in others where the length of receptacle 58 requires an extra long elongated member 68, a locking mechanism 70, including a key 82, a cylindrical lock 72 and an elongated member 68, may be inserted into each end of receptacle 58. Therefore, instead of one end of receptacle 58 being closed, each end of the receptacle will contain a channel 74, which would each receive a locking mechanism 70.

The embodiments illustrated in FIG. 8–16 allow multiple male electrical plugs to be inserted and locked within a receptacle. The receptacle 58 may be comprised of virtually any material, including but not limited to, metal such as aluminum, wood, plastic, and the like. The locking mechanism 70 includes a standard lock 72. Preferably, the lock 72 is a standard cylinder lock using either a key or a combination although other types of locks may be employed. Member 68 can be coupled to the end of lock 72 or be manufactured as an integral portion of the lock. Member 72 can be of any elongated shape, provided it is of a narrower diameter than the openings 64 in the prongs 66. Electrical plugs in the United States must include openings in the prongs, and they are generally of uniform diameter. Preferably, the member 68 is cylindrical, and rounded at its end to facilitate the insertion of the member 68 into each opening 64.

The device of the present invention accommodates electrical plugs having three prongs (the third being the ground). The receptacle 58 is substantially rectangular and has a height of such dimensions as to allow the ground prong of a plug to extend over the top of the receptacle. In this fashion, the ground plug would clear the top of the receptacle and not interfere with the plug insertion.

Figure 17A:
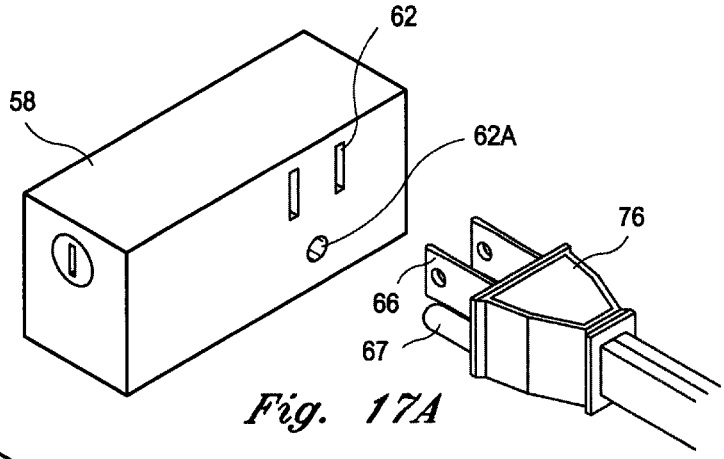
FIG. 17A and 17B show and alternate embodiment of the receptacle of the present invention to accommodate a ground plug.
Figure 17B:
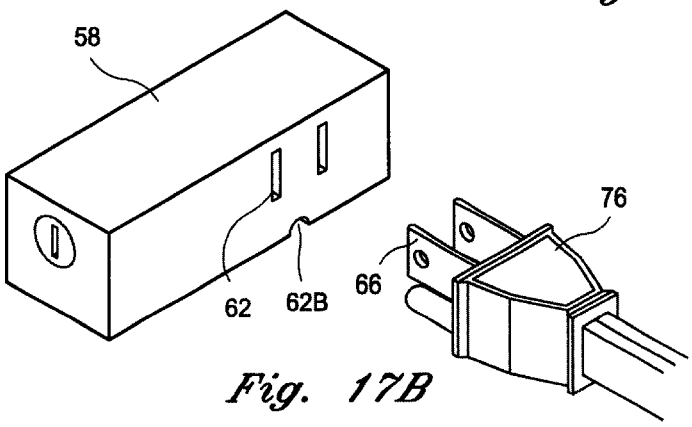

FIGS. 17A and 17B show an alternate embodiment that accommodates the ground prong 67 of an electrical plug. A third groove 62A, in the shape of the ground prong 67 of the electrical plug can be included under the grooves 62, as shown in FIG. 17A. Groove 62A can be shaped to accommodate any ground plug shape. Alternatively, receptacle 58 can include a half-rounded semi-circle 62B along the lower edge as shown in FIG. 17B. This would allow for the prongs 66 of each plug 76 to be fully inserted into grooves 62 and properly aligned within receptacle 58. The semi-circular groove receives the top portion of the ground prong allowing the ground prong to smoothly slide beneath the receptacle while prongs 66 are being retained within the receptacle 58. Again, third groove 62B need not be semicircular and can instead conform to whatever the shape of the ground prong may be.

To further protect the receptacle 58 during non-use, a sleeve, comprised of any suitable material such as, but not limited to, metal, plastic or cloth, may be fitted over the receptacle. To use the invention, a user would then just slip the receptacle out of its sleeve, exposing the grooves and channel, and use the receptacle along with the locking mechanism in the manner described above.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A compact locking device for securing one or more male electrical plugs therein, each plug having one or more elongated prongs having an opening therethrough, the device comprising:

a receptacle for housing the one or more male electrical plugs, the receptacle having one or more prong-receiving grooves extending transversely through the receptacle and an elongated channel extending longitudinally through at least a portion of the length of the receptacle, wherein the longitudinal axis of the elongated channel is transverse the longitudinal axis of the grooves; and a locking mechanism having an elongated prong-securing member coupled thereto, the elongated member sized to fit through the prong openings when the one or more prongs are inserted within the receptacle, where upon insertion of the locking mechanism within the receptacle, the elongated prong-securing member pierces at least one said opening in each said plug thereby securing the one or more electrical plugs within the receptacle, wherein the locking mechanism includes a locking flange and the receptacle includes a retaining notch within its interior, wherein the locking flange engages the retaining notch upon activation of the locking mechanism thereby preventing the elongated member from being removed from the receptacle.

2. The device of claim 1 wherein the locking mechanism is a cylinder lock.

3. The device of claim 2 wherein the cylinder lock is secured within the receptacle by turning of a key.

4. The device of claim 2 wherein the cylinder lock is secured within the receptacle by rotation of dials on the lock.

5. The device of claim 1 where the one or more male electrical plugs are aligned within the receptacle in a side-by-side manner.

6. The device of claim 1 where the one or more male electrical plugs are aligned within the receptacle in an opposing manner such that a prong of a first plug is disposed between the prongs of an opposing plug.

7. The device of claim 1 wherein the channel has a larger first end to accommodate the locking mechanism and a smaller tapered second end to allow only the elongated prong-securing member to protrude therethrough.

8. The device of claim 1 wherein the receptacle is sized to allow a ground prong of the plug to extend over the top or bottom of the receptacle when the plug is inserted within the receptacle.

9. A compact locking device for securing one or more male electrical plugs therein, each plug having one or more elongated prongs having an opening therethrough, the device comprising:

a receptacle for housing the one or more male electrical plugs, the receptacle having a plurality of prong-receiving grooves and an elongated channel extending longitudinally through at least a portion of the receptacle, the elongated channel positioned transverse to a longitudinal direction of the grooves; and a locking mechanism, the locking mechanism comprised of a cylindrical lock and an elongated prong-securing member coupled to the cylindrical lock, the elongated member sized to fit through the prong openings when the one or more prongs are inserted within the receptacle, where upon insertion of the cylindrical lock within the receptacle, the prong-securing member pierces the opening in each said prong thereby securing the one or more electrical plugs within the receptacle, the cylindrical lock further including a locking flange extending therefrom and the receptacle includes a retaining notch within its interior, wherein the locking flange engages the retaining notch upon activation of the locking mechanism thereby preventing the elongated member from being removed from the receptacle.

10. The device of claim 9 wherein pairs of grooves are disposed on opposite sides of the receptacle such that the prongs are inserted into the grooves in an overlapping manner, a prong of one plug aligned between the prongs of an opposing plug.

11. A compact locking receptacle for retaining one or more male electrical plugs therein, each plug having one or more elongated prongs having an opening therethrough, the receptacle comprising one or more prong-receiving grooves extending transversely through the receptacle and an elongated channel adapted to receive a locking mechanism and an elongated prong-securing member coupled thereto, the elongated member sized to fit through the prong openings when the one or more prongs are inserted within the receptacle, wherein the elongated channel extends longitudinally through at least a portion of the length of the receptacle and the longitudinal axis of the elongated channel is transverse the longitudinal axis of the prong-receiving grooves, wherein the receptacle includes a retaining notch within its interior, wherein upon activation of the locking mechanism, the retaining notch is adapted to receive a locking flange protruding from the locking mechanism thereby preventing the elongated member from being removed from the receptacle.

* * * * *